US007021473B2

(12) United States Patent
Langford et al.

(10) Patent No.: US 7,021,473 B2
(45) Date of Patent: Apr. 4, 2006

(54) FAUCET DISPLAY UNIT

(75) Inventors: Jonathan Langford, Putnoe (GB); David Wolfenden, Saddleworth (GB)

(73) Assignee: Damixa A/S, (DK)

( * ) Notice: Subject to any disclaimer, the term of this patent is extended or adjusted under 35 U.S.C. 154(b) by 0 days.

(21) Appl. No.: 10/674,948

(22) Filed: Sep. 30, 2003

(65) Prior Publication Data

US 2004/0217071 A1 Nov. 4, 2004

(51) Int. Cl.
*A47F 7/00* (2006.01)

(52) U.S. Cl. ..... 211/13.1

(58) Field of Classification Search ..... 211/13.1, 211/126.1, 10, 11; 206/557; D6/574
See application file for complete search history.

(56) References Cited

U.S. PATENT DOCUMENTS

| | | | | |
|---|---|---|---|---|
| 2,688,408 | A * | 9/1954 | Binggely | 211/13.1 |
| 3,233,744 | A * | 2/1966 | Ripps | 211/119.009 |
| 6,035,857 | A * | 3/2000 | Hartelius et al. | 132/73 |
| 6,065,478 | A * | 5/2000 | Hartelius et al. | 132/73 |
| 6,591,990 | B1 * | 7/2003 | Lanman et al. | 211/10 |
| 6,796,441 | B1 * | 9/2004 | Tremblay | 211/74 |

* cited by examiner

*Primary Examiner*—Sarah Purol
(74) *Attorney, Agent, or Firm*—Kwadjo Adussi-Poku; Lloyd D. Doigan

(57) ABSTRACT

A rigid display unit for displaying kitchen and bathroom faucets, comprising an upper back shelf having at least one hole therein, and a lower front shelf. The lower front shelf has a downwardly-sloping portion with two co-planar side portions adjacent to the down-wardly sloping portion. The lower front shelf also contains a plurality of holes for receiving faucet for display to the customer. A plurality of recesses are provided to display informational literature.

4 Claims, 3 Drawing Sheets

FAUCET DISPLAY UNIT

FIELD OF THE INVENTION

The present invention relates to a display unit, in particular for displaying kitchen and bathroom faucet sets for retail sale.

BACKGROUND OF THE INVENTION

In retail outlets it is difficult to display many families of products together and allow easy selection of a particular product by a customer: This can lead to a customer-becoming frustrated by the selection process and either rot purchasing a product or else making the wrong selection. Furthermore, display units which can display many families of products together are expensive and difficult to install. They also provide low product density, that is to say, they do not allow many products to be displayed in a given area. This increases the cost of displaying a number of families of products. Also, in known prior art devices, if a particular family of products is discontinued or if a new family of products is introduced, it can be time consuming and expensive to change the display of products to accommodate such changes. In known devices, information relating to a family of products and to each product within that family cannot be clearly presented. Also, known display units have to be transported to a retail outlet without the products to be displayed installed. Installing the display products in the retail outlet in a display area can be time consuming and expensive. It can also lead to a loss of sales whilst the display area is disrupted.

SUMMARY OF THE INVENTION

The invention in its various aspects comprises a rigid display unit, in particular for displaying kitchen and bathroom, faucets. The display unit comprises an upper back shelf having at least one hole in it and a lower front shelf having a sloping portion which slopes downwards from the back to the front of the lower shelf and which is located between two co-planar side portions which each have at least one hole.

A preferred embodiment of the invention is described in more detail below with reference to the drawings, and takes the form of a rigid display unit, in particular for displaying kitchen and bathroom faucets. The display unit comprises an upper back shelf having at least one hole in it and a lower front shelf having a sloping portion which slopes downwards from the back to the front of the lower shelf. The sloping portion is located between two co-planar side portions which each have at least one hole.

BRIEF DESCRIPTION OF THE DRAWINGS

The invention will now be described in more detail, by way of example, with reference to the drawings, in which.

DETAILED DESCRIPTION OF THE INVENTION

Figure 1:
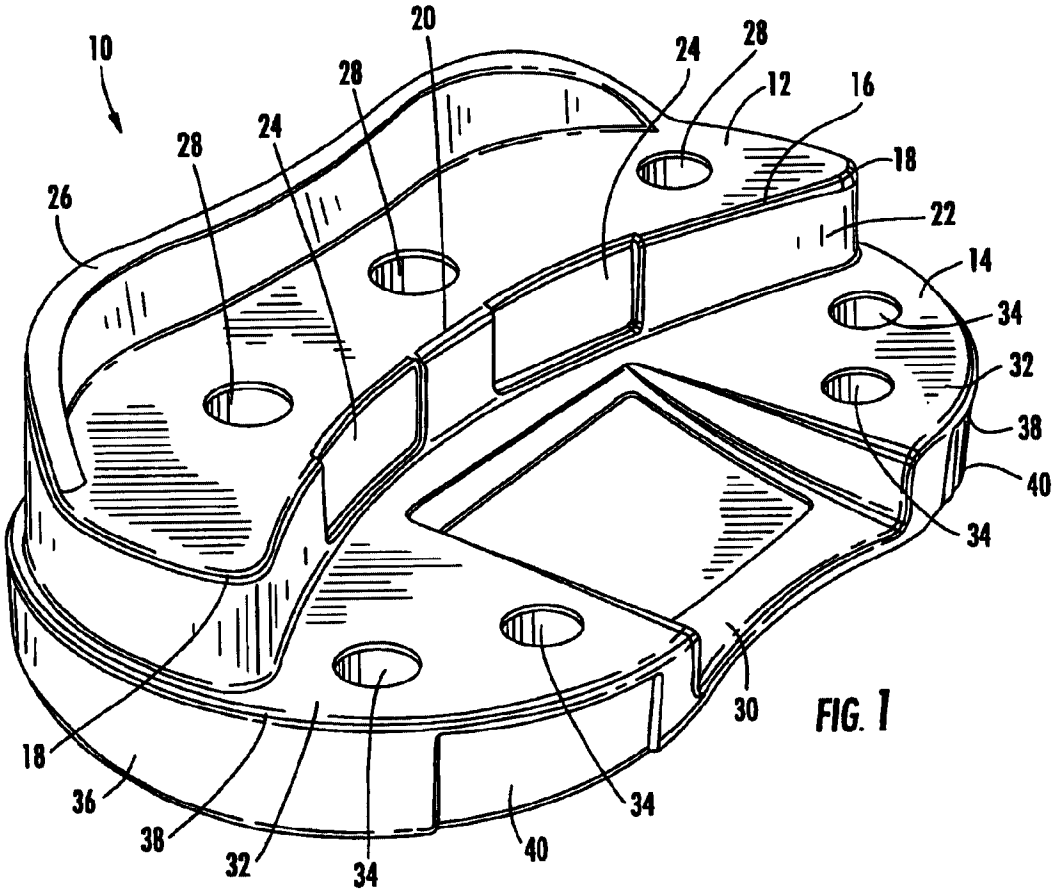
FIG. 1 shows a front perspective view of a display unit in accordance with the present invention.

FIG. 1 shows a rigid display unit 10 for displaying, among other things, kitchen and bathroom faucets for retail sale. The display unit 10 depicted in this preferred embodiment has a generally oval shape. It has an upper back shelf 12 and a lower front, shelf 14 which are integrally formed. The depending front edge 16 of the upper shelf 12 curves between two outer corners 18 through an apex 20, in a concave sense as seen from the front of the unit, the apex 20 is behind the outer corners 18. This curved portion forms a back wall 22 to the lower shelf 14. The back wall 22 may incorporate a plurality of rectangular recesses 24 for small information sheets. However, labels and other media may be used to provide consumer information regarding the faucets.

The surface of the upper shelf 12 is flat and the back edge 25 has a narrow ridge 26 running along it, the two ends of which slope down to meet the upper shelf 12. The upper shelf 12 has a plurality of holes 28 in it which can house faucets, and preferably mixer faucets, in order to display them on the upper shelf 12.

The lower shelf 14 has a recessed slope 30 or cut-out, between two co-planar flat side portions 32 forming the shelf surface, that slopes downwardly from the back to the front. The slope 30 is for a large information sheet.

Each of the flat side portions 32 has a plurality of holes 34. Each hole 34 can house a faucet for display. A flange 36 extends downwardly and around the whole of the display unit 10 from the edge 38 of each of the flat side portions 32, the slope 30, and the upper shelf 12. Below each flat side portion 32, the flange 36 may incorporate a rectangular recess 40 to receive information sheets. As with the recesses 24 on back wall 22 of the upper shelf 12, it is envisioned that adhesive labels or other media may be used instead of the recesses to inform customers of the faucets.

Each faucet (not shown) is held to the display unit 10 by passing its threaded inlet pipe through a hole 28, 34 and using a nut to hold each inlet pipe in place. It is thus located in a similar manner to the way it will be located when in situ in a basin or bath. Although this attachment method is preferred, other suitable attachment methods are envisioned by this invention.

Figure 2:
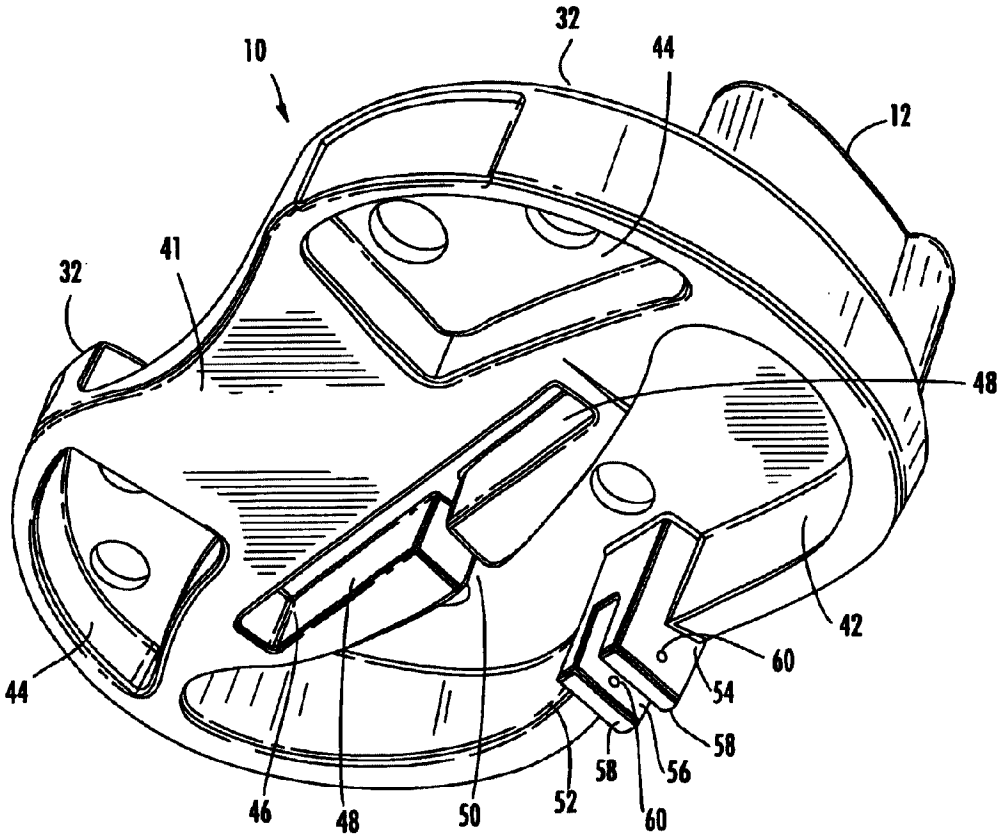
FIG. 2 shows a bottom perspective view of the display unit according to the invention.

FIG. 2 shows a bottom perspective view of the under side 41 of the display unit 10. Beneath the back upper shelf 12 is a deep recess 42 and beneath each of the flat side portions 32 of the lower shelf 14 is a shallow recess 44. These recesses 42, 44 house the inlet pipes of the faucets and nuts that protrude into the under side 41 of the display unit 10 and conceal them from view.

In the centre of the under side 41 of the display unit 10 is a T-shape recess 46 substantially in a plane-parallel to the shelves 12,14. The arms 48 of the T-shape recess 46 extend transversely of the unit generally towards the shallow recesses 44, and the base 50 of the T-shape recess 46 extends fore and aft towards and abutting the deep recess 42. Extending from the middle of the back wall 52 of the deep recess 42 is a block 54 with an elongate channel 56 in it formed between two sidewalls 58. The channel 56 extends from the back towards the front of the display unit 10 in line with the base 50 of the T-shaped recess 46. Each of the side walls 58 of the channel has an aligned transverse hole 60 through it sized to receive a narrow bolt.

The display unit 10 is attached to a display frame by a metal T-shape support bracket (not shown) that extends outwardly from the display frame. The base of the T-shape bracket is attached to the display frame. The arms of the T-shape bracket mate with the arms 48 of the T-shape recess 46 in the under side 41 of the display unit 10 to support the weight of the unit, and the base of the T-shape bracket mates with the base 50 of the T-shape recess 46 and the channel 56 in the block 54. A bolt is passed through the aligned holes 60 in the sidewalls 58 of the channel 56 and through corresponding holes in the base of the T-shape bracket and retained by a nut screwed onto the bolt. The T-shape support bracket is attached to the display frame in such a way that the display unit tilts forwardly downwardly at a desired angle, typically of 10–15 degrees, to present the faucets on the upper and lower shelves most effectively to the purchaser.

Many display units 10 can be mounted to the same display frame in a vertical and/or horizontal array. The angle at which the individual display units 10 are mounted to the display frame need not be the same. For example, the angle of the display units closer to the ground can be less steep than the display units 10 further from the ground. The display units 10 mounted closest to the ground may be substantially parallel to the ground.

The display unit 10 of FIGS. 1 and 2, is preferably used to display a family of faucets comprising: a bath mixer faucet assembly for mounting to a bath and which is connected to two of the holes 28 on the upper shelf 12; a basin mixer faucet assembly for mounting to a basin and which is connected to the third hole 28 on the upper shelf 12; a pair of basin faucets for mounting to a basin which are connected to the holes 34 in one of the flat side portions 32 of the lower shelf 14; and a pair of bath faucets for mounting to a bath which are connected to the holes 34 in the other flat side portion 32 of the lower shelf 14.

The large information sheet may have information on it relating to the family of faucets. The small information sheets may have information on them relating to a particular neighbouring faucet on the upper shelf or pair of faucets on the lower shelf. More generally, recessed portions may be provided on any of the upward and/or forward facing surfaces of the display unit, for receiving information sheets.

Preferably, the display unit 10 is made from an acrylic material and particularly high impact acrylic.

The faucets have been described as being secured by nuts. Alternatively, or additionally, the faucets may be held to the display unit 10 using a suitable adhesive or other attachment means.

Figure 4:
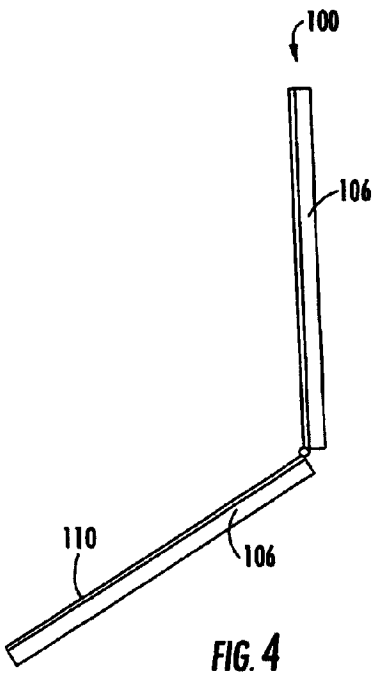
FIG. 4 shows a top plan view of the alternate display unit of the present invention.
Figure 3:
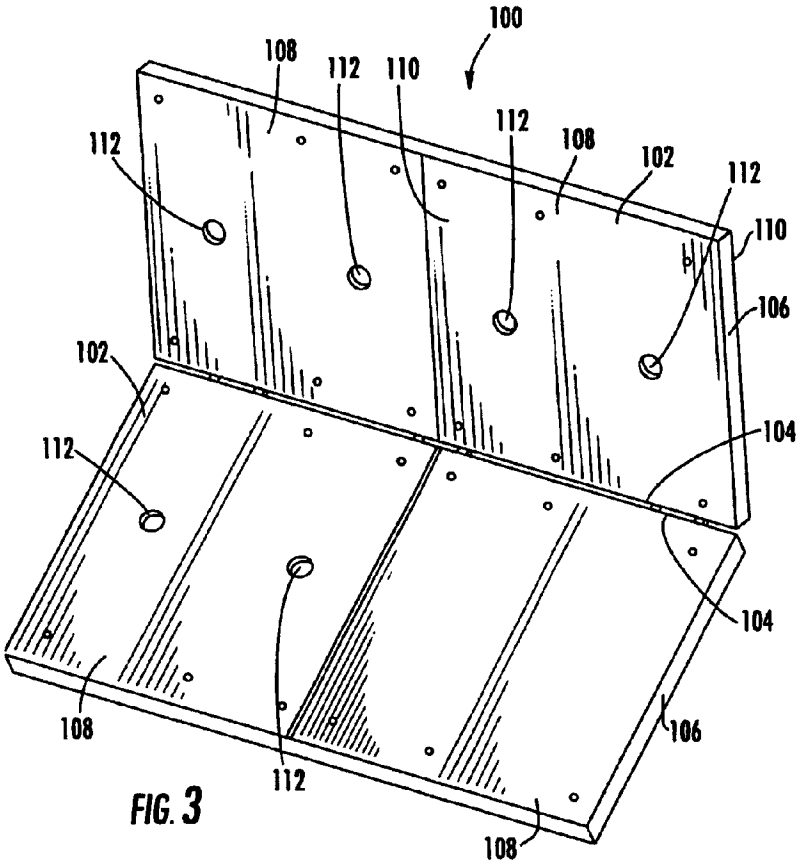
FIG. 3 shows a perspective view of an alternate display unit as envisioned by the instant invention.

An alternative display unit 100 is shown in FIGS. 3 and 4. A plurality of rectangular panels 102 are hingedly attached to each other with the longitudinal edges 104 of the panels 102 being positioned close together. Preferably, the transverse edges 106 of the panels 102 are at an angle to each other, as shown best in FIG. 4. A preferred angle of approximately 60° is illustrated. Each rectangular panel 102 may be subdivided into a plurality of rectangular panes 108, preferably having bevelled edges 110. In a preferred embodiment as shown in FIG. 3, certain rectangular panes 108 have a plurality of holes 112 therein, to which faucets can be attached. Selected panes 108*a* may be left without any holes therein, in order to receive information sheets thereon. For simplicity of construction, each rectangular pane 108 may be constructed containing the holes 112 therein. In this situation, the information sheets would simply cover up the holes and would not be visible to the customer.

In one preferred display, the display unit 100 is mounted to a display frame such that the rectangular panel 102 with the plurality of holes 112 forms a back panel 114. A plurality of rectangular panels 102 may then extend outward at some desired angle from either side of the back panel 114.

The display unit 100 of FIGS. 3 and 4 is preferably used to display a family of faucets comprising: a bath mixer faucet assembly for mounting to a wall above a bath and which is attached to the back panel 114; a basin mixer faucet assembly for mounting to a wall above a basin and which is also attached to the back panel 114; and a pair of bath faucets for mounting to a wall above a bath which is attached to the outwardly-extending panels 102.

An information sheet may be positioned anywhere on the rectangular portions 102, such as in the centre of a pane 108*a*, or in the centre of the back panel 114. Faucets may be attached to the alternative display unit 100 of FIGS. 3 and 4 in the same way as the display unit 10 of the first embodiment described above, or in some other suitable way, such that the faucets extend outwards and can be viewed to best advantage by the customer.

Embodiments of the present invention have been described with particular reference to the examples illustrated. However, it will be appreciated that variations and modifications may be made to the examples described within the scope of the present invention.

The invention claimed is:

1. A rigid display unit comprising:

an upper back shelf having a top planar portion and a downwardly-extending skirt, the top planar portion having at least one hole therein, and the skirt having an inwardly-curving front section, the front section containing a plurality of recesses therein, such that the recesses may receive descriptive literature; and a lower front shelf having a back edge and a front edge, and having a sloping portion and planar side portions on either side of the sloping portion, the sloping portion sloping downwards from the back edge of to the front edge of the lower shelf;

a plurality of holes located in the planar side portions of the lower front shelf; and wherein the upper back shelf and the lower front shelf each has a topside and an underside, the underside of the upper back shelf containing a deep recess therein surrounded by a perimeter wall.

2. The display unit according to claim 1, wherein the underside of the lower front shelf has a plurality of shallow recesses situated concurrent with the planar side portions.

3. The display unit according to claim 2, further comprising a T-shaped recess having a body portion and arm portions, the T-shaped recess being located on the underside of the lower front shelf, such that the body portion of the T-shaped recess extends towards the deep recess on the underside of the upper back shelf.

4. The display unit according to claim 3, further comprising an attachment block having an elongate channel therein, the attachment block being located along the perimeter wall of the deep recess on the underside of the upper back shelf, the elongate channel being aligned with the body portion of the T-shape recess.

* * * * *